United States Patent [19]

Lu et al.

[11] Patent Number: 4,480,021

[45] Date of Patent: Oct. 30, 1984

[54] TONER COMPOSITIONS CONTAINING NEGATIVE CHARGE ENHANCING ADDITIVES

[75] Inventors: Chin H. Lu; Christopher J. AuClair, both of Webster, N.Y.

[73] Assignee: Xerox Corporation, Stamford, Conn.

[21] Appl. No.: 474,011

[22] Filed: Mar. 10, 1983

[51] Int. Cl.[3] ..... G03G 9/08

[52] U.S. Cl. ..... 430/106.6; 430/109; 430/110; 430/108

[58] Field of Search ..... 430/110, 109, 106.6, 430/108

[56] References Cited

U.S. PATENT DOCUMENTS

| | | | |
|---|---|---|---|
| 3,577,345 | 5/1971 | Jacknow et al. | 430/110 |
| 3,893,934 | 7/1975 | Braun et al. | 430/110 |
| 4,002,776 | 1/1977 | Braun et al. | 430/110 |
| 4,298,672 | 11/1981 | Lu . | |
| 4,338,390 | 7/1982 | Lu . | |

*Primary Examiner*—John E. Kittle

*Assistant Examiner*—John L. Goodrow

*Attorney, Agent, or Firm*—E. O. Palazzo

[57] ABSTRACT

This invention is directed to a negatively charged toner compositions comprised of resin particles and pigment particles, and from about 0.1 percent by weight to about 20 percent by weight, of an aryl sulfone, or aryl alkyl sulfonamide negative charge enhancing additive of the following formulas.

$$R_1—SO_2—R_2 \quad \text{I}$$

$$R_3—SO_2—NH—R_4 \quad \text{II}$$

wherein $R_1$ is an alkyl group containing from about 6 carbon atoms to about 22 carbon atoms, or an aryl group, $R_2$ is an aryl group containing from about 6 carbon atoms to about 18 carbon atoms, $R_3$ is an aryl group, and $R_4$ is an alkyl group independent from $R_1$, containing from about 6 carbon atoms to about 22 carbon atoms, or an aryl group.

19 Claims, No Drawings

TONER COMPOSITIONS CONTAINING NEGATIVE CHARGE ENHANCING ADDITIVES

BACKGROUND OF THE INVENTION

This invention is generally directed to new toner compositions and developer compositions, containing certain charge enhancing additives. More specifically, the present invention is directed to developer compositions containing toner particles and negative charge enhancing additives comprised of aryl sulfones, or aryl sulfonamides, which additives impart a negative charge to the toner resin particles. Developer compositions containing the charge enhancing additives of the present invention are useful for causing the development of electrostatic latent images, including color images. Furthermore, the colored developer compositions of the present invention can be selectred for use with common carrier particles comprised of the same composition.

Developer compositions containing charge enhancing additives which impart a positive charge to the toner resin particles are known. However, very few developer compositions have been described in the prior art wherein the charge enhancing additives are selected for the purpose of imparting a negative charge to the toner resin particles. Examples of toner compositions containing charge enhancing additives which impart a positive charge to the toner resin particles include those described in U.S. Pat. No. 3,893,934, wherein there is disclosed the use of certain quaternary ammonium compounds as charge control agents for electrostatic toner compositions; U.S. Pat. No. 4,298,672, which discloses developer compositions containing as charge enhancing additives certain alkyl pyridinium halides, such as cetyl pyridinium chloride; and U.S. Pat. No. 4,338,390, wherein there is illustrated the use of certain sulphates and sulphonates, including stearyl dimethyl phenethyl ammonnium para-toluene sulphonate, as positive charge enhancing additives.

Moreover, there is described in a copending application negative charging enhancing additives comprised of ortho-halophenylcarboxylic acids, and the use of developer compositions containing such additives for causing the development of colored images in xerographic imaging systems.

Nevertheless, there continues to be a need for toner compositions contianing negative charge enhancing additives, that is where a negative charge is imparted to the toner resin particles. Additionally, there is a need for developer compositions containing charge enhancing additives that are capable of imparting substantially similar negative charges to the toner particles irrespective of color. Furthermore, there continues to be a need for toner compositions which can be incorporated into developer compositions containing common carrier particles, which developer compositions can be selected for use in developing colored xerographic images. Moreover, there continues to be a need for toner, and developer compositions, which are humidity insensitive, of uniform charge distribution, and which possess fast charging characteristics.

Also, there continues to be a need for negative charge enhancing materials that are compatible with the toner resin particles, and are relatively non-toxic in comparison to prior art negative charge enhancing additives, such as certain organic acids, fluoro acids, and metal complexes of organic acids, which acids are not completely compatible with the toner resin particles, and in many instances these acids are considered to be toxic.

SUMMARY OF THE INVENTION

It is an object of the present invention to provide toner compositions, and developer compositions which overcome some of the noted disadvantages.

Another object of the present invention resides in the provision of negatively charged toner compositions which are useful for causing the development of electrostatic latent images, including color images.

In yet another object of the present invention there are provided negatively charged toner compositions containing as charge enhancing additives aryl alkyl sulfonamides.

In yet a further object of the present invention there is provided negatively charged toner compositions containing as charge enhancing additives aryl sulfones.

In a further object of the present invention there are provided color developer compositions comprised of toner particles, carrier particles, and negative charge enhancing additves comprised of an aryl alkyl sulfonamide, or an aryl sulfone, these additives imparting a negative charge to the toner resin particles.

Another object of the present invention resides in the provision of a method for developing xerographic color images with a developer composition comprised of resin particles, pigment particles, carrier particles and negative charge enhancing additives comprised of aryl alkyl sulfonamides, or aryl sulfones.

These and other objects of the present invention are accomplished by the provision of electrostatic toner compositions, and developer compositions thereof, wherein the toner composition is comprised of resin particles, colorants or pigment particles, and negative charge enhancing additives selected from the group consisting of aryl aklyl sulfonamides, and aryl sulfones of the following formulas:

$$R_1—SO_2—R_2 \qquad \text{I}$$

$$R_3—SO_2—NH—R_4 \qquad \text{II}$$

wherein $R_1$ is an alkyl group containing from about 6 carbon atoms to about 22 carbon atoms, or an aryl group, $R_2$ is an aryl group containing from about 6 carbon atoms to about 18 carbon atoms, $R_3$ is an aryl group, or an alkyl group, and $R_4$ is an alkyl group independent from $R_3$ containing from about 6 carbon atoms to about 22 carbon atoms, or an aryl group.

Illustrative examples of alkyl groups include methyl, ethyl, propyl, butyl, pentyl, hexyl, octyl, nonyl, decyl, myristyl, cetyl, oleyl, pentadecyl heptadecyl, stearyl, eicosyl, and the like. Preferred alkyl groups for $R_1$ include those containing from about 12 carbon atoms to about 18 carbon atoms such as cetyl and stearyl.

Illustrative examples of aryl groups include those containing from about 6 carbon atoms to about 18 carbon atoms, such as phenyl, naphthyl, benzyl, biphenyl, and the like. The preferred aryl group is phenyl.

Specific examples of aryl sulfones selected for the charge enhancing additive of the present invention include stearyl para-tolyl sulfone, cetyl p-tolyl sulfone, myristyl p-tolyl sulfone, isopropyl biphenyl p-tolyl sulfone, naphthyl p-tolyl sulfone, stearyl p-xylyl sulfone, and the like, with stearyl para-tolyl sulfone and isopropyl biphenyl para-tolyl sulfone being preferred. Specific illustrative examples of aryl alkyl sulfonamides include para-tolyl stearyl sulfonamide, p-tolyl cetyl sulfonamide, p-xylyl stearyl sulfonamide, p-tolyl myristyl sulfonamide, isopropyl biphenyl stearyl sulfonamide, and the like, with para-tolyl stearyl sulfonamide being preferred.

The aryl sulfone or alkyl sulfonamides negative charge enhancing additives of the present invention, which are available from Hexcel Corporation, can be incorporated into toner compositions, and developer compositions in various amounts providing that there are no substantial adverse effects on compositions involved, and there results a toner that is negatively charged in comparison to the carrier particles. Thus, for example, the amount of aryl sulfone or aryl alkyl sulfonamide incorporated into the toner composition is from about 0.1 percent by weight to about 20 percent by weight, and preferably from about 1 percent by weight to about 5 percent by weight based on the weight of the toner particles. In one preferred embodiment, the charge enhancing additives of the present invention are present in the toner composition in an amount from about 1 percent by weight to about 3 percent by weight.

The aryl sulfones and aryl alkyl sulfonamide negative charge enhancing additives of the present invention can be blended into the toner composition, or coated on the colorant or pigment particles, such as carbon black, cyan pigments, magenta pigments or yellow pigments. When selected as a coating, the charge enhancing additives of the present invention are present in an amount of from about 2 percent by weight to about 20 percent by weight, and preferably in this embodiment these additives are present in an amount of from about 5 percent by weight to about 10 percent by weight.

Various methods can be selected for preparing the toner, and the developer compositions of the present invention, one method involving melt blending resin particles, pigment particles, and the charge enhancing additives of the present invention, followed by mechanical attrition. Other methods include those well known in the art such as spray drying, melt dispersion, dispersion polymerization, and suspension polymerization. In the dispersion polymerization process, a solvent dispersion of resin particles, pigment particles and the charge enhancing additives of the present invention are spray dried under controlled conditions resulting in the desired product. A toner prepared in this manner results in a negatively charged toner in relationship to the carrier materials present in the developer composition, and these compositions exhibit the improved properties as mentioned hereinbefore.

Various suitable resins can be utilized with the charge enhancing additives of the present invention. Typical resins include, for example, thermoplastic materials, such as polyamides, epoxies, polyurethanes, vinyl resins, and polyesters, especially those prepared from dicarboxylic acids and diols comprising diphenols. Any suitable vinyl resin may be selected as the toner resin, including homopolymers or copolymers of two or more vinyl monomers. Typical of such vinyl monomeric units include: styrene, chlorostyrene, vinyl naphthalene, ethylenically unsaturated monolefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of aliphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like, and N-vinyl indole, N-vinyl pyrrolidene copolycarborates, styrenebutadiene resins, and the like; and mixtures thereof. Any of the vinyl resins may be blended with one or more other resins, preferably other vinyl resins, which provide for the required triboelectric properties, and uniform resistance against physical degradation. However, non-vinyl type thermoplastic resins may also be employed including resin modified phenol formaldehyde resins, oil modified epoxy resins, polyurethane resins, cellulosic resins, polyether resins, and mixtures thereof.

Generally, toner resins containing relatively high percentages of styrene are preferred. The styrene resin selected can be a homopolymer of styrene, or styrene homologs, and copolymers of styrene with other monomeric groups. Any of the above typical monomeric units may be copolymerized with styrene by addition polymerization. Styrene resins may also be formed by the polymerization of a mixture of two or more unsaturated monomeric materials with a styrene monomer. The addition polymerization technique employed embraces known polymerization techniques such as free radical, anionic, and cationic polymerization processes.

Also, esterification products of a dicarboxylic acid, and a diol comprising a diphenol may be selected as a preferred resin material for the toner composition of the present invention. These compositions are illustrated in U.S. Pat. No. 3,655,374, the disclosure of which is totally incorporated herein by reference, the diphenol reactant being of the formula as shown in Column 4, beginning at line 5, of this patent, and the dicarboxylic acid being of the formula as shown in Column 6.

The resin particles are present in the toner composition in an amount that provides a total of about 100 percent for all toner ingredients, thus when 5 percent by weight of the charge enhancing composition of the present invention is present, and 10 percent by weight of pigment or colorant particles such as carbon black are present, about 85 percent by weight of toner resin particles are incorporated into the toner composition.

With regard to developer compositions utilized for the development of electrostatic latent images wherein there results a black image, various suitable pigments or dyes can be selected as the colorant for the toner particles, such materials being well known, and including, for example, carbon black, magnetite, iron oxides, nigrosine dye, chrome yellow, ultramarine blue, duPont oil red, methylene blue chloride, phthalocyanine blue, and mixtures thereof. The pigment or dye should be present in the toner in sufficient quantity to render it highly colored, thus allowing the toner composition to create, for example, a clearly visible image on the recording member. Thus, for example, when conventional xerographic copies of documents are desired, the toner may comprise a black pigment, such as carbon black, or a black dye such as Amaplast black dye available from the National Aniline Products, Inc. Preferably, the pigment particles are incorporated into the toner composition in amounts of from about 3 percent to about 50 percent by weight based on the total weight of the toner particles, however, when the pigment selected is a dye, substantially smaller quantities, for example, less than 10 percent by weight, may be used.

With regard to developer compositions for obtaining color images, there is selected as the colorant or pigment component those particles containing Litho Scarlet pigments, including Litho Scarlet red, cyan pigments, magenta pigments, yellow pigments, and mixtures thereof. Illustrative examples of cyan pigments include copper tetra-4-(octadecylsulfonamido)phthalocyanine, the X-copper phthalocyanine pigment listed in the color index as CI 74160, CI Pigment Blue 15, an Anthradanthrene Blue, identified in the color index as CI 61890, Special Blue X-2137 and the like; while illustrative examples of yellow pigments that may be selected include diarylide yellow 3,3-dichloro benzidene acetoacetanilide, a monoazo pigment identified in the color index as CI 12700, CI Solvent Yellow 16, a nitrophenyl amine sulfonamide identified in the color index as Foron Yellow SE/GLF, CI Dispersed Yellow 33, 2,5-dmethoxy-4-sulfonoanilide, phenylazo-4-chloro-2,5-dimethoxy acetoacetanilide, Permanent Yellow FGL, and the like. Illustrative examples of magenta materials that may be selected as pigments include, for example, 2,9-dimethyl substituted quinacridone and anthraquinone dye identified in the color index as CI 60710, CI Dispersed Red 15, a diazo dye identified in the color index as CI 26050, CI Solvent Red 19 and the like.

The Litho Scarlet, cyan, magenta, and yellow pigments, when utilized with the charge enhancing additives of the present invention are generally incorporated into the toner composition in an amount of from about 2 weight percent to about 30 weight percent, and preferably in an amount from about 5 weight percent to about 15 weight percent, based on the weight of the toner particles.

Various suitable carrier particles can be incorporated into the developer composition of the present invention, providing that the toner particles are charged negatively in comparison to the carrier particles. Thus, the carrier particles are selected so as to acquire a charge of a positive polarity, and include materials such as steel, nickel, iron ferrites, silicon dioxide and the like. The carrier particles usually contain coatings such as polymers of styrene, methyl methacrylate and silanes, ethyl cellulose, and the like. Many of the typical carriers that can be used are described in U.S. Pat. No. 2,638,522. Also, nickel berry carriers as disclosed in U.S. Pat. Nos. 3,847,604, and 3,767,598, containing coatings thereon, can be used these carriers being nodular carrier beads of nickel characterized by surfaces of reoccuring recesses and protrusions, thus providing particles with a relatively large external area. The diameter of the coated carrier particle is from about 50 to about 1,000 microns, thus allowing these particles to possess sufficient density and inertia to avoid adherence to the electrostatic images during the development process.

The carrier particles may be blended with the toner composition in various suitable combinations, however, best results are obtained when about 1 part of toner particles to about 10 to about 200 parts by weight of carrier particles are selected.

The toner and developer compositions of the present invention may be used to develop electrostatic latent images, including color images, on various suitable imaging surfaces, capable of retaining charge including, for example, conventional photoreceptor surfaces known in the art, such as inorganic photoconductors, like selenium, and layered photoresponsive devices wherein a positive charge resides on the photoresponsive surface, which method comprises contacting the electrostatic latent image with the developer composition of the present invention, followed by transferring the resulting image to suitable substrate, and optionally permanently affixing the image by, for example, heat. In addition to selenium, illustrative examples of useful inorganic photoreceptors include amorphous silicon, halogen doped amorphous selenium, selenium alloys, cadmium sulfide, zinc oxide, and the like. Amorphous selenium, and a selenium arsenic alloy containing about 99.95 percent selenium and about 0.5 percent arsenic are preferred. Color images can be obtained by using, for example, a single pass process as described in U.S. Pat. No. 4,312,932 the disclosure of which is totally incorporated herein by reference.

The following examples are being supplied to further define certain embodiments of the present invention, it being noted that these examples are intended to be illustrative only, and are not intended to limit the scope of the present invention. Parts and percentages are by weight unless otherwise indicated.

EXAMPLE I

There was prepared two (2) red toner compositions by melt blending followed by mechanical attrition. Control toner composition A contained 9.6 percent by weight of the red pigment Lithol Scarlet red, 0.4 percent by weight of the magenta pigment 2,9-dimethyl quinacridone, and 90 percent by weight of a styrene/n-butyl methacrylate copolymer resin containing 58 perecent by weight of styrene, and 42 percent by weight of n-butyl methacrylate.

Toner composition B contained 2 percent by weight of the negative charge enhancing additive stearyl paratolyl sulfone available from Hexcel Company, Lodi, N.J., 9.6 percent of the red pigment Lithol Scarlet red, 0.4 weight percent of the magenta pigment, 2,9-dimethylquinacridone and 88 percent by weight of a styrene/n-butyl methacrylate copolymer resin, containing 58 percent by weight of styrene and 42 percent by weight of n-butyl methacrylate.

The triboelectric properties of these toner compositions were then measured using a Faraday Cage against ferrite carrier particles consisting of a ferrite core coated with 0.35 percent by weight of ethyl cellulose, at a 2 percent by weight toner concentration, with the following results:

| Toner Composition | Stearyl p-Tolyl Sulfone % | Toner Tribo Microcoulombs Per Gram uc/g | | | |
|---|---|---|---|---|---|
| | | 10 Min.* | 60 Min. | 180 Min. | 300 Min. |
| A | 0 | −31 | −27 | −20 | −17 |
| B | 2 | −42 | −42 | −28 | −28 |

*Min. represents minutes.

Toner composition B which contained the sulfone charge enhancing additive of the present invention had a higher negative toner triboelectric charge value than toner composition A, and also toner composition B had faster admix charging behavior than the control toner composition A as evidenced by charge spectrograph measurements.

The triboelectric properties of the above prepared toner compositions were then measured using a Faraday Cage against ferrite carrier particles consisting of a ferrite core coated with 0.5 weight percent of a styrene methyl methacrylate, vinyl triethoxy-silane terpolymer resin, reference U.S. Pat. No. 3,256,533, at a 2 percent by weight toner concentration, with the following results:

| Toner Composition | Stearyl p-Tolyl Sulfone % | Toner Tribo Microcoulombs Per Gram uc/g | | | |
|---|---|---|---|---|---|
| | | 10 Min. | 60 Min. | 180 Min. | 300 Min. |
| A (Control) | 0 | −10 | −12 | −11 | −10 |
| B | 2 | −16 | −20 | −19 | −20 |

Toner composition B, which contained the sulfone charge enhancing additive indicated exhibited higher negative toner triboelectric charging values than toner composition A which did not contain the sulfone charging enhancing additive.

The stearyl para-tolyl sulfone charge enhancing additive selected for use in this example, which was synthesized by Hexcel Chemical Company has a melting point of 74° C. to 77° C. and is believed to be of the following formula:

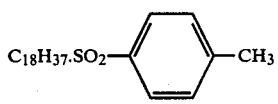

EXAMPLE 2

There was prepared two (2) red toner compositions by melt blending, followed by mechanical attrition. Control toner composition E contained 9.6 percent by weight of the red pigment Lithol Scarlet red, 0.4 percent by weight of the magenta pigment 2,9-dimethyl quinacridone, and 90 percent by weight of a styrene/n-butyl methacrylate copolymer resin containing 58 percent by weight of styrene, and 42 percent by weight of n-butyl methacrylate.

Toner composition F contained 2 percent by weight of the negative charge enhancing additive isopropyl biphenyl para-tolyl sulfone, available from Hexcel Company, Lodi, N.J., 9.6 weight percent of the red pigment Lithol Scarlet red, 0.4 weight percent of the magenta pigment, 2,9-dimethyl quinacridone, and 88 percent by weight of a styrene/n-butyl methacrylate copolymer resin, containing 58 percent by weight of styrene, and 42 percent by weight of n-butyl methacrylate.

The triboelectric properties of these toner compositions were then measured using a Faraday Cage against ferrite carrier particles consisting of a ferrite core coated with 0.5 weight percent of a styrene, methyl methacrylate, vinyltriethoxysilane, terpolymer resin, reference U.S. Pat. No. 3,256,533, at a 2 percent by weight toner concentration, with the following results:

| Toner Composition | Isopropyl biphenyl para-tolyl Sulfone % | Toner Tribo Microcoulombs Per Gram u/c/g | | | |
|---|---|---|---|---|---|
| | | 10 Min.* | 60 Min. | 180 Min. | 300 Min. |
| E | 0 | −9 | −14 | −16 | −17 |
| F | 2 | −15 | −20 | −28 | −30 |

*Min. represents minutes.

The isopropyl biphenyl para-tolyl sulfone charge enhancing additive selected for use in this example, which was synthesized by Hexcel Chemical Company, has a melting point of 128° C. to 130° C. and is believed to be of the following formula:

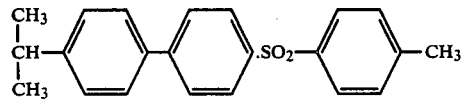

EXAMPLE 3

Two (2) red toner compositions were prepared by melt blending followed by mechanical attrition. Control toner composition C contained 9.6 percent by weight of the red pigment Lithol Scarlet, 0.4 percent by weight of the magenta pigment 2,9 dimethyl quinacridone, and 90 percent by weight of a styrene/n-butyl methacrylate copolymer resin, containing 58 percent by weight of styrene, and 42 percent by weight of n-butyl methacrylate.

Toner composition D contained 2 percent by weight of para-tolyl stearyl sulfonamide, available from Hexcel Company, 9.6 percent by weight of Lithol Scarlet red pigment, 0.4 percent by weight of the magenta pigment 2,9-dimethyl quinacridone, and 88 percent by weight of styrene/n-butyl methacrylate coplymer, containing 58 percent by weight of styrene and 42 percent by weight of n-butyl methacrylate.

Triboelectric measurements were then affected for these toner compositions with a Faraday Cage, against ferrite carrier particles, consisting of ferrite core, coated with 0.35 percent by weight of ethyl cellulose at a 2 percent by weight toner concentration with the following results:

| Toner Composition | Para-tolyl Stearyl Sulfonamide % | Toner Tribo Microcoulombs Per Gram uc/g | | | |
|---|---|---|---|---|---|
| | | 10 Min. | 60 Min. | 180 Min. | 300 Min. |
| C (Control) | 0 | −31 | −27 | −20 | −17 |
| D | 2 | −43 | −39 | −29 | −27 |

Toner composition D which contained the sulfonamide charge enhancing additive of the present invention possess significantly higher negative triboelectric values than control toner composition C. Additionally, toner composition D had faster admix charging rates as evidenced by measurements on a charge spectrograph.

The triboelectric values for the above-identified toner compositions were also accomplished with a Faraday Cage against carrier particles containing a ferrite core coated with 0.5 percent by weight of a styrene, methyl methacrylate, vinyltriethoxy silane terpolymer, reference U.S. Pat. No. 3,526,533 at a two percent by weight toner concentration, with the following results:

| Toner Composition | Para-tolyl Stearyl Sulfonamide % | Toner Tribo Microcoulombs Per Gram (uc/g) 10 Min. | 60 Min. | 180 Min. | 300 Min. |
|---|---|---|---|---|---|
| C (Control) | 0 | −10 | −12 | −11 | −10 |
| D | 2 | −15 | −19 | −18 | −18 |

The para-tolyl stearyl sulfonamide, selected for use in this example, was synthesied by Hexcel Company, and had a melting point of 88° C. to 90° C., and is believed to be of the following formula:

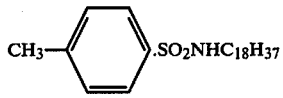

EXAMPLE 4

Developer compositions were prepared by mixing together 200 parts per weight of the toner compositions of Examples 1, 2, and 3, containing the charge enhancing additive specified, with 100 parts by weight of carrier particles consisting of a ferrite core coated with 0.35 percent by weight of ethyl cellulose. There is also prepared developer compositions by mixing together two parts by weight of the toner compositions of Examples 1, 2, and 3, containing the charge enhancing additive specified, with 100 parts by weight of carrier particles consisting of a ferrite core coated with 0.5 percent by weight of a methyl methacrylate, styrene, vinyl triethoxy silane terpolymer, reference U.S. Pat. No. 3,526,533.

The resulting developer compositions were then selected to develop latent electrostatic images formed on an amorphous selenium photoreceptor device charged positively, and there resulted color copies of excellent quality utilizing a single pass xerographic color imaging process.

Other modifications of the present invention may occur to those skilled in the art based upon a reading of the present disclosure and these are intended to be included within the scope of the present invention.

We claim:

1. A negatively charged toner composition comprised of resin particles, and pigment particles, and from about 0.1 percent to about 20 percent by weight of an aryl sulfone negative charge exhancing additive of the formula $R_1$—$SO_2$—$R_2$ wherein $R_1$ is an alkyl group containing from about 6 carbon atoms to about 22 carbon atoms, or an aryl group, and $R_2$ is an aryl group containing from about 6 carbon atoms to about 18 carbon atoms.

2. A toner composition in accordance with claim 1 wherein $R_1$ is an alkyl group containing from about 12 carbon atoms to about 18 carbon atoms, and $R_2$ is an aryl group containing from 6 carbon atoms to about 18 carbon atoms.

3. A toner composition in accordance with claim 1 wherein the charge enhancing additive is isopropyl biphenyl para-tolyl sulfone.

4. A toner composition in accordance with claim 1 wherein the charge enhancing additive is para-tolyl stearyl sulfone.

5. A toner composition in accordance with claim 1 wherein the aryl sulfone charge enhancing additive is stearyl para-tolyl sulfone, cetyl p-tolyl sulfone, naphthyl para-tolyl sulfone, myristyl para-tolyl sulfone, stearyl para-xylyl sulfone, or isopropyl biphenyl para-tolyl sulfone.

6. A toner composition in accordance with claim 1 wherein the resin particles are comprised of a styrene/n-butyl methacrylate copolymer.

7. A toner composition in accordance with claim 1 wherein the pigment particles are carbon black, magnetite, cyan, magenta, yellow, lithol scarlet red, or mixtures thereof.

8. A toner composition in accordance with claim 1 wherein the pigment particles are comprised of red pigments.

9. A developer composition comprised of resin particles, pigment particles, carrier particles, and from about 0.1 percent by weight to about 20 percent by weight of the aryl sulfones negative charge enhancing additives of claim 1.

10. A developer composition in accordance with claim 9 wherein the charge enhancing additive is isopropyl biphenyl para-tolyl sulfone.

11. A developer composition in accordance with claim 9 wherein the charge enhancing additive is para-tolyl stearyl sulfone.

12. A developer composition in accordance with claim 9 wherein the resin particles are comprised of a styrene/n-butyl methacrylate copolymer.

13. A developer composition in accordance with claim 9 wherein the carrier particles consist of a ferrite core coated with a terpolymer of styrene, methyl methacrylate, and a silane.

14. A developer composition in accordance with claim 9 wherein the carrier particles consist of a steel core coated with ethyl cellulose.

15. A developer composition in accordance with claim 9 wherein the pigment particles are comprised of carbon black, or magnetite.

16. A developer composition in accordance with claim 9 wherein the pigment particles are comprised of a material selected from cyan, magenta, and yellow pigments, litho scarlet red, or mixtures thereof.

17. A developer composition in accordance with claim 16 wherein the magenta pigment is 2,9-dimethyl quinacridone.

18. A method for developing electrostatic latent image comprising forming a positive electrostatic latent image on an inorganic photoresponsive device, contacting the resulting image with the developer composition of claim 9 followed by transferring the image to a suitable substrate, and optionally permanently affixing the image thereon.

19. A method of imaging in accordance with claim 18 wherein the pigment particles are comprised of cyan, magenta, and yellow pigments, litho scarlet red, or mixtures thereof and the charge enhancing additive is para-tolyl stearyl sulfone, isopropyl biphenyl para-tolyl sulfone.

* * * * *